US006313808B1

(12) United States Patent
Yuanzhu

(10) Patent No.: US 6,313,808 B1
(45) Date of Patent: Nov. 6, 2001

(54) FREEDHORN CAPABLE OF RECEIVING RADIO WAVES FROM PLURALITY OF NEIGHBORING SATELLITES

(75) Inventor: Dou Yuanzhu, Fukushima-ken (JP)

(73) Assignee: Alps Electric Co., Ltd., Tokyo (JP)

( * ) Notice: Subject to any disclaimer, the term of this patent is extended or adjusted under 35 U.S.C. 154(b) by 0 days.

(21) Appl. No.: 09/573,758

(22) Filed: May 18, 2000

(30) Foreign Application Priority Data

May 20, 1999 (JP) ..... 11-140723
Jul. 21, 1999 (JP) ..... 11-206836

(51) Int. Cl.[7] ..... H01Q 13/02
(52) U.S. Cl. ..... 343/786
(58) Field of Search ..... 343/776, 786; H01Q 13/02

(56) References Cited

U.S. PATENT DOCUMENTS 5,635,944 * 6/1997 Weinstein et al. ..... 343/776
5,812,096 * 9/1998 Tilford ..... 343/776

FOREIGN PATENT DOCUMENTS 10-163737 6/1998 (JP) .
11-274847 10/1999 (JP) .

* cited by examiner

*Primary Examiner*—Michael C. Wimer
(74) *Attorney, Agent, or Firm*—Brinks, Hofer, Gilson & Lione

(57) ABSTRACT

A feedhorn of the invention comprises: at least first and second waveguides in positions so as to face each other over a center line, each having an axis parallel to the center line; and first and second horns on extension lines of the axes. The outer ends of the first and second horns have aperture end faces, respectively. Each of the aperture end faces of the first and second horns is tilted toward the center line by a predetermined angle so that the first and second horns are perpendicular to the travel directions of radio waves transmitted from at least two broadcasting satellites orbiting around the earth and reflected by an antenna on the ground.

10 Claims, 6 Drawing Sheets

FREEDHORN CAPABLE OF RECEIVING RADIO WAVES FROM PLURALITY OF NEIGHBORING SATELLITES

BACKGROUND OF THE INVENTION

1. Field of the Invention

The present invention relates to a feedhorn for a parabolic antenna used in a receiving unit of an antenna for receiving a satellite broadcast signal. More particularly, the invention relates to a feedhorn suitable to receive radio waves from a plurality of neighboring satellites.

2. Description of the Related Art

An example of a conventional feedhorn for receiving radio waves from a plurality of neighboring satellites will be described. Japanese Unexamined Patent Publication No. Hei 10-163737 discloses a feedhorn in which two waveguides are integrally formed and which can receive radio waves from neighboring two satellites.

In such a conventional feedhorn 23, as shown in FIGS. 12 and 13, first and second circular waveguides 21*a* and 21*b* each having a predetermined length and a diameter are formed. Around the first and second circular waveguides 21*a* and 21*b*, first and second grooves 22*a* and 22*b* each having a predetermined depth are formed by partition walls 22*c*, 22*d*, and 22*e*.

As shown in FIG. 13, the partition walls 22*c*, 22*d*, and 22*e* are formed so that their aperture end faces at the front end are flush with the same plane and their heights are the same.

A substrate 24 is disposed at the bottom of the first and second circular waveguides 21*a* and 21*b*. A feeding point 25 is provided so as to be positioned in the center of the bottom face of each of the circular waveguides 21*a* and 21*b* by printed wiring formed on the substrate 24. Further, a terminating unit 26 is attached to the bottom face of the feedhorn 23.

The conventional feedhorn 23 is attached to a receiving antenna and can receive radio waves transmitted from neighboring two broadcasting satellites by the first and second waveguides 21*a* and 21*b*.

A predetermined angle is, however, formed between the two neighboring broadcasting satellites to the feedhorn on the ground. Consequently, although either one of the aperture end faces formed on the same plane of the first and second circular waveguides 21*a* and 21*b* of the feedhorn can be adjusted at the predetermined angle formed by the neighboring two broadcasting satellites to the feedhorn, the other one cannot be adjusted. There is consequently a problem that radio waves from either one of the neighboring two broadcasting satellites cannot be properly received.

In order to solve the problem, it is possible to prepare two feedhorns (not shown) each having a single waveguide and attach the feedhorns to a receiving antenna so as to position each of the waveguides of the feedhorns at the angle formed by the neighboring two broadcasting satellites to feedhorn. There is, however, a problem such that assembly of the receiving antenna to which the feedhorns each having a single waveguide are separately attached is complicated and the cost is high.

The number of satellites recently launched is very large. A feedhorn provided with two waveguides can receive radio waves from only two satellites and has a problem that the feedhorn cannot receive radio waves from three or more satellites.

SUMMARY OF THE INVENTION

The present invention has been achieved to solve the problems and its object is to provide an easy-to-manufacture low-cost feedhorn capable of properly receiving radio waves transmitted from a plurality of neighboring satellites.

As a first solving means for solving the problems, there is provided a feedhorn comprising: first and second waveguides at least in positions so as to face each other over a center line, each having an axis parallel to the center line; and first and second horns linked to the first and second waveguides, respectively, on extension lines of the axes of the first and second waveguides, wherein the first waveguide and the first horn have an aperture formed in the axial direction, the second waveguide and the second horn have an aperture formed in the axial direction, the former aperture is provided with an aperture end face at an outer end of the first horn, the latter aperture is provided with an aperture end face at an outer end of the second horn, the diameter of the aperture on the aperture end face side is larger than that on the side of each of the first and second waveguides, the aperture on the side of each of the first and second horns conically tapers inward, and each of the aperture end faces of the first and second horns of the first and second waveguides is tilted toward the center line by a predetermined angle so that the first and second horns are perpendicular to the travel directions of radio waves transmitted from at least two broadcasting satellites orbiting around the earth and reflected by an antenna on the ground.

As a second solving means for solving the problems, on the internal conical face, a plurality of concentrical grooves having different distances from the axis are formed at a predetermined depth by being partitioned with partition walls, an end face of each of the partition walls is formed flatly, the partition walls are arranged so that their heights are different from each other like stairs, and the end face of each of the partition walls is formed in parallel with the aperture end face of the horn.

As a third solving means for solving the problems, the depth direction of each of the grooves is in parallel with the center line.

As a fourth solving means for solving the problems, an inclination angle of each of the aperture end faces of the first and second waveguides and the end faces of the partition walls lies within the range from 2 to 10 degrees with respect to a plane which perpendicularly crosses the center line.

As a fifth solving means for solving the problems, an inclination angle of each of the aperture end faces of the first and second waveguides and the end faces of the partition walls is set to the half of an angle formed between a plurality of neighboring broadcasting satellites and a receiving antenna on the ground for receiving radio waves transmitted from the broadcasting satellites.

As a sixth solving means for solving the problems, a third waveguide having an axis parallel to the center line is disposed between the first and second waveguides in positions off from the center line, the third waveguide has a third horn which is on an extension line of the axis and is linked to the third waveguide, an aperture is formed in the axial direction in the third waveguide and the third horn, the aperture is provided with an aperture end face at the outer end of the third horn, the diameter of the aperture on the aperture end face side is larger than that on the third waveguide side, the aperture on the third horn side conically tapers inward, and the aperture end face of each of the first, second, and third horns is inclined toward the center line at a predetermined angle so that the first, second, and third horns are perpendicular to the travel directions of radio waves which are transmitted from neighboring three broadcasting satellites orbiting around the earth and reflected by an antenna on the ground.

As a seventh solving means for solving the problems, the first, second, and third waveguides are arranged in a state where a line connecting the axes of the first and second waveguides is deviated from the axis of the third waveguide by a predetermined distance.

DETAILED DESCRIPTION OF THE PREFERRED EMBODIMENTS

Figure 1:
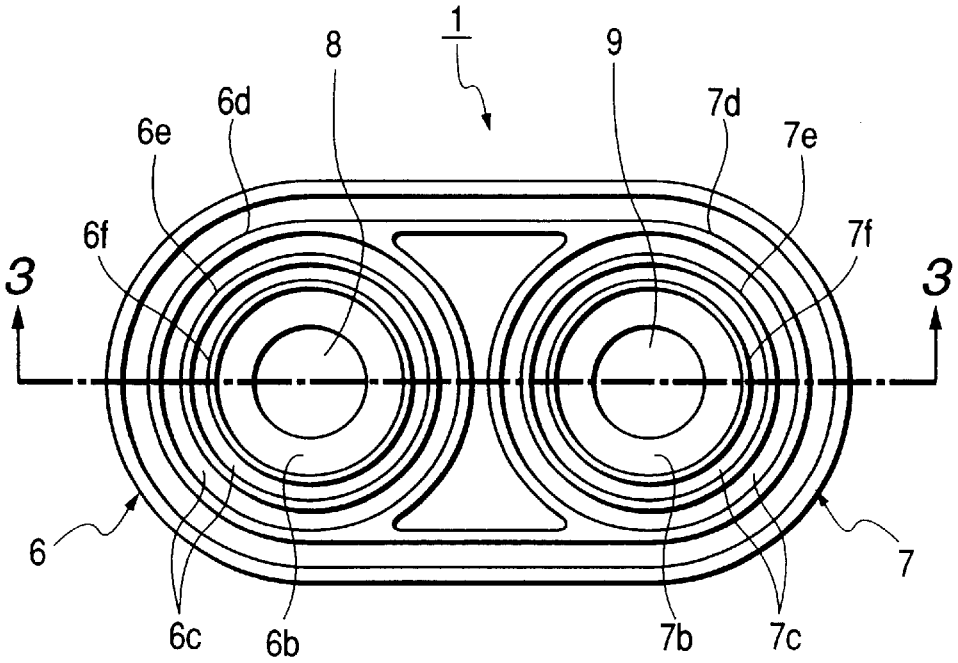
FIG. 1 is a plan view of a feedhorn according to a first embodiment of the invention.
Figure 2:
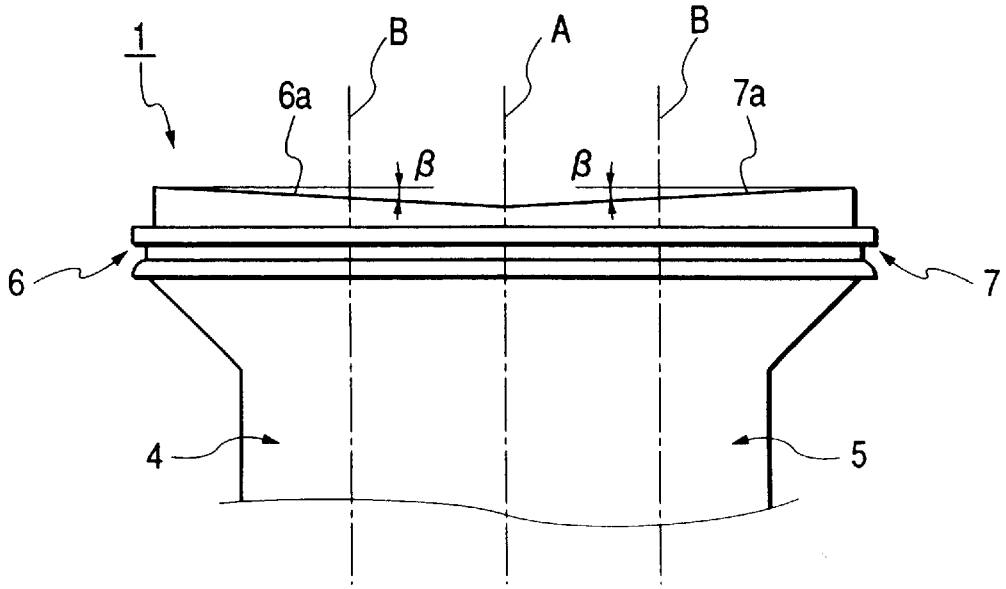
FIG. 2 is a front view of the feedhorn of FIG. 1.
Figure 3:
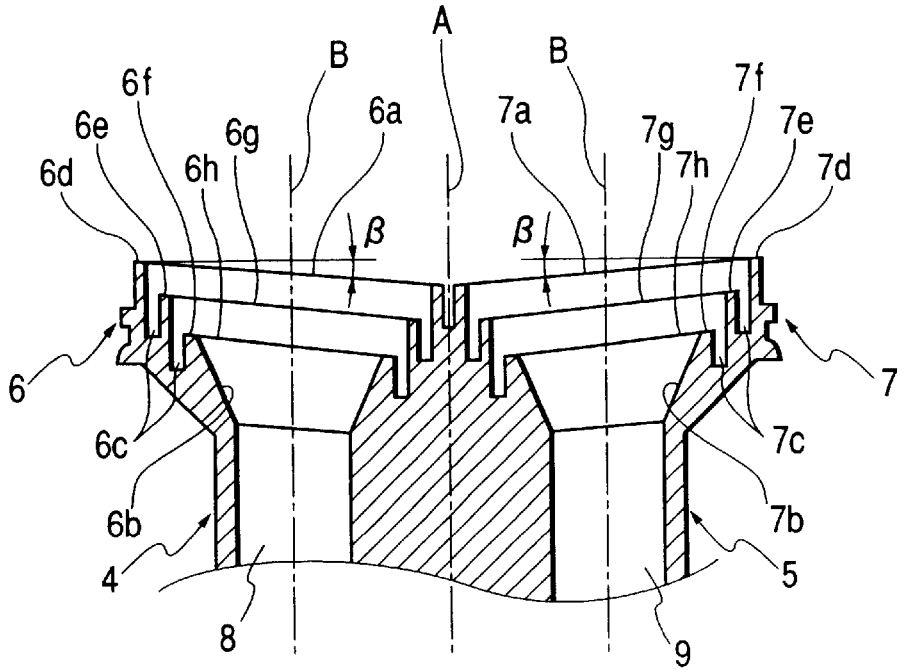
FIG. 3 is a cross section of the main part of the feedhorn of FIG. 1.
Figure 4:
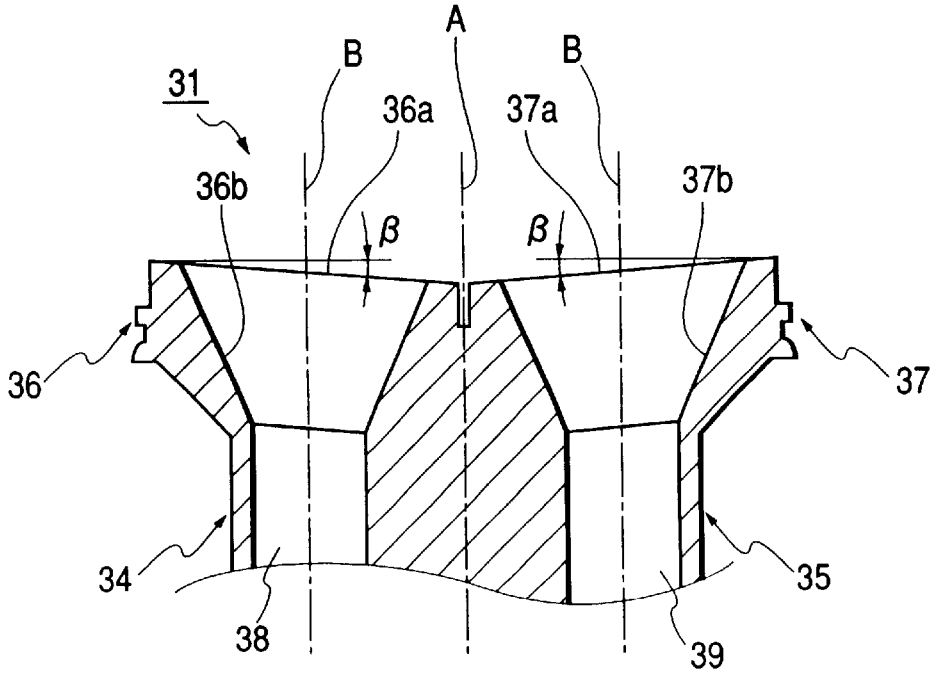
FIG. 4 is a cross section of the main part of a modification of the first embodiment of the invention.
Figure 5:
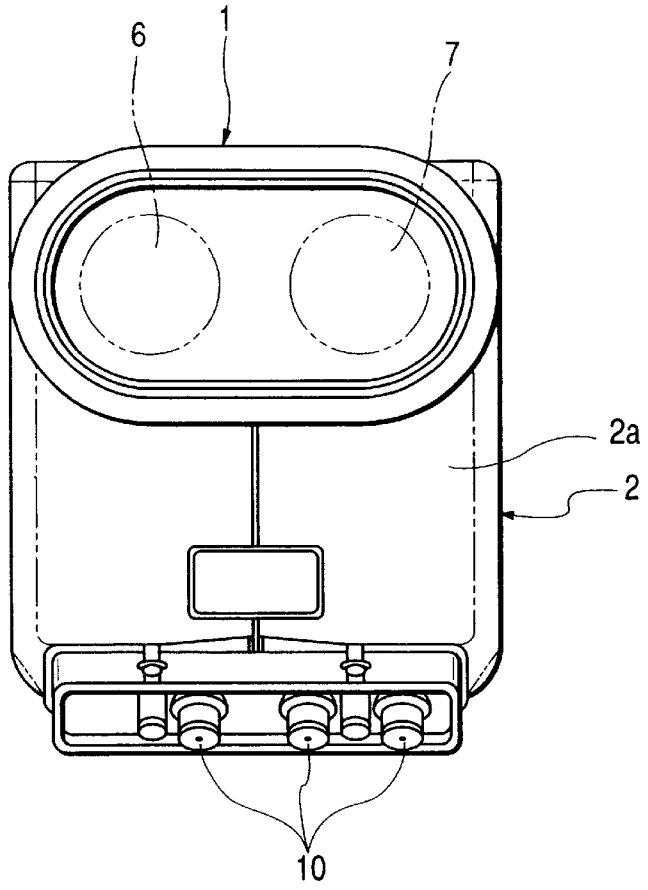
FIG. 5 is a front view of a converter to which a feedhorn of the first embodiment of the invention is attached.
Figure 6:
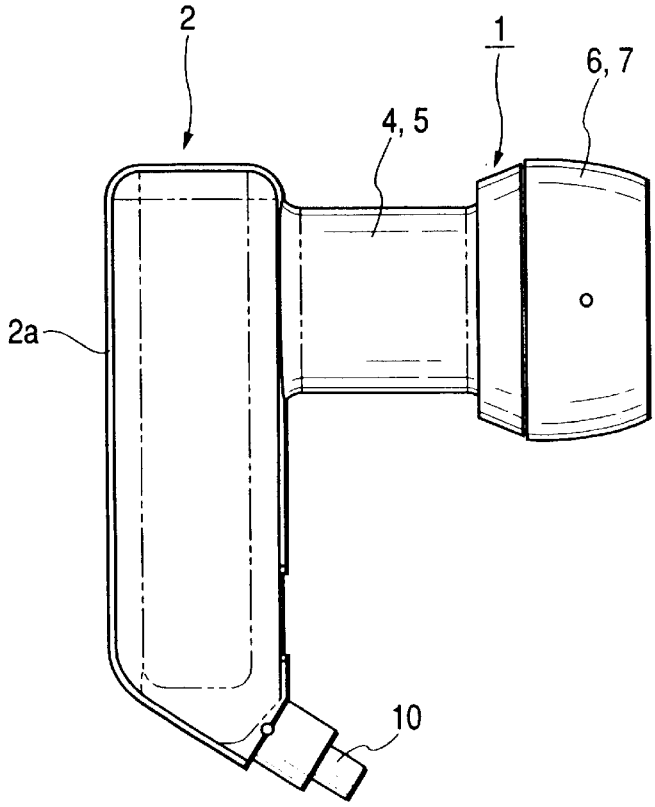
FIG. 6 is a side view of the converter of FIG. 5.
Figure 7:
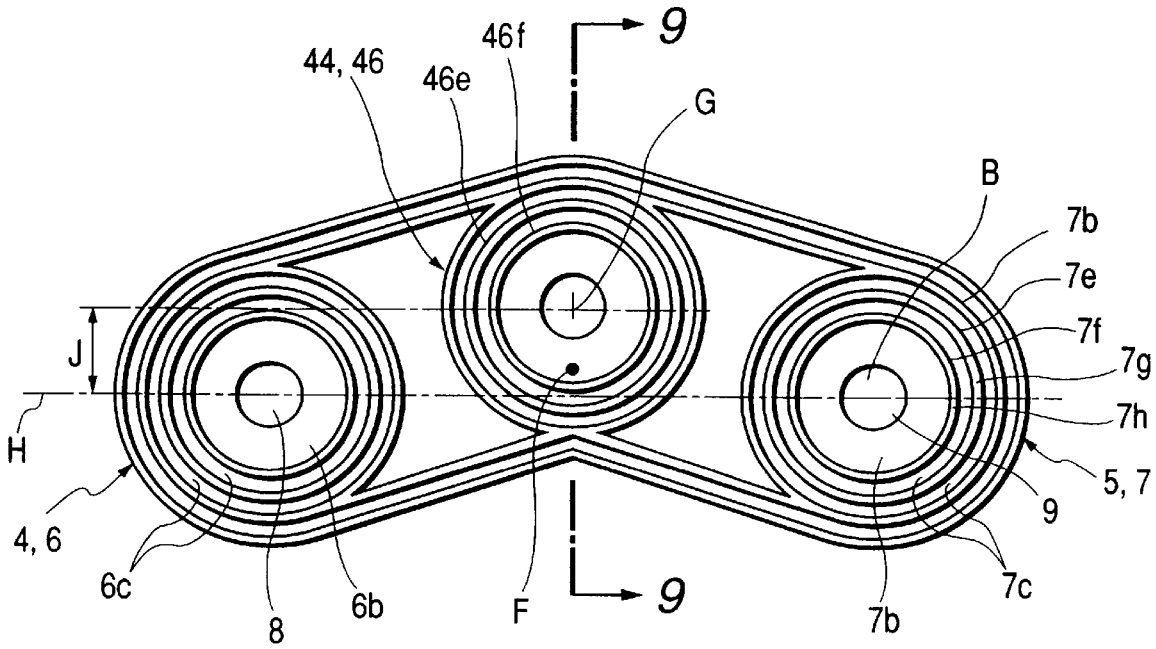
FIG. 7 is a plan view of a feedhorn according to a second embodiment of the invention.
Figure 8:
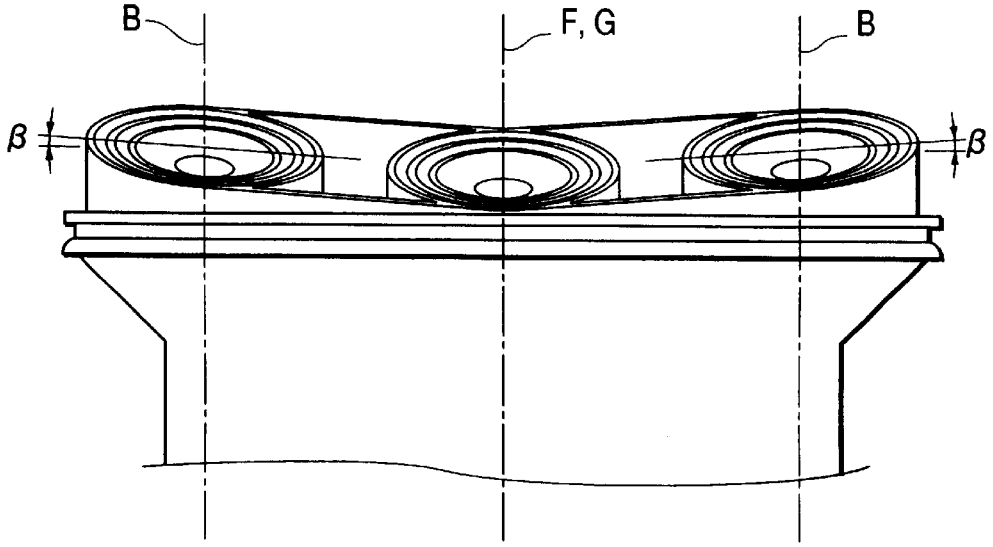
FIG. 8 is a front view of the feedhorn of FIG. 7.
Figure 9:
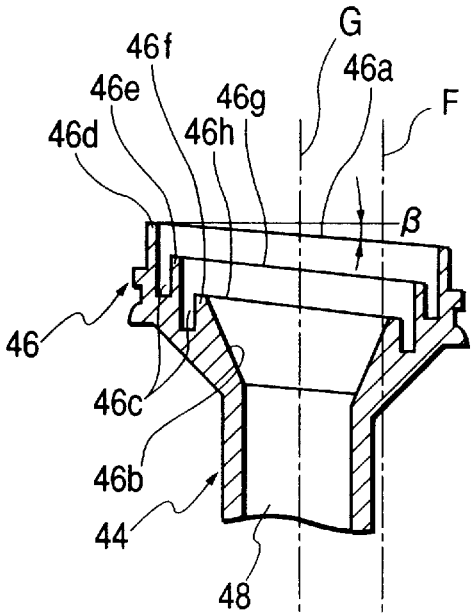
FIG. 9 is a cross section of the main part of the feedhorn of FIG. 7.
Figure 10:
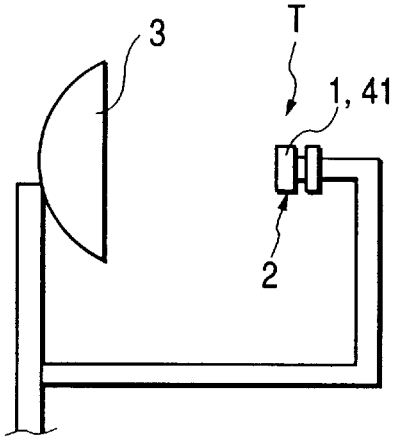
FIG. 10 is a schematic view for explaining a receiving antenna according to the invention.
Figure 11:
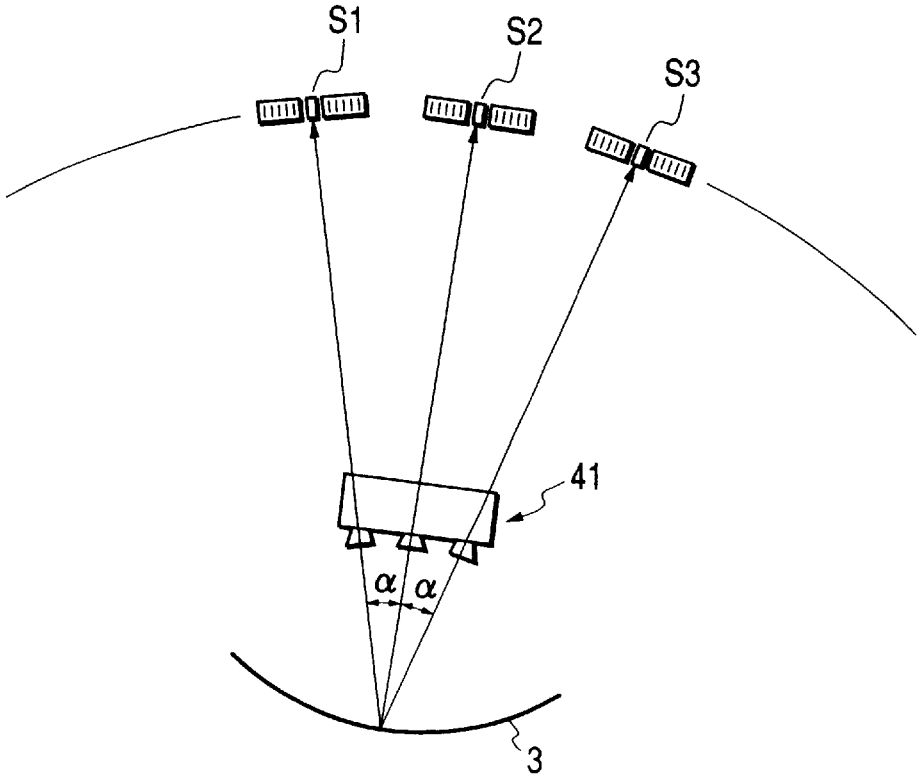
FIG. 11 is a schematic view for explaining the relation with broadcasting satellites according to the invention.
Figure 12:
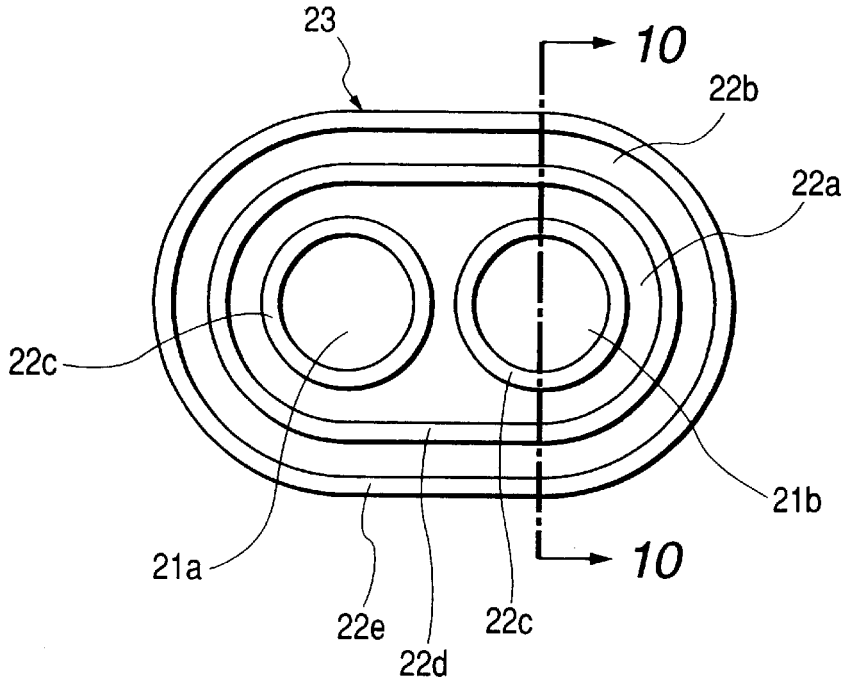
FIG. 12 PRIOR ART
FIG. 12 is a plan view of a conventional feedhorn.
Figure 13:
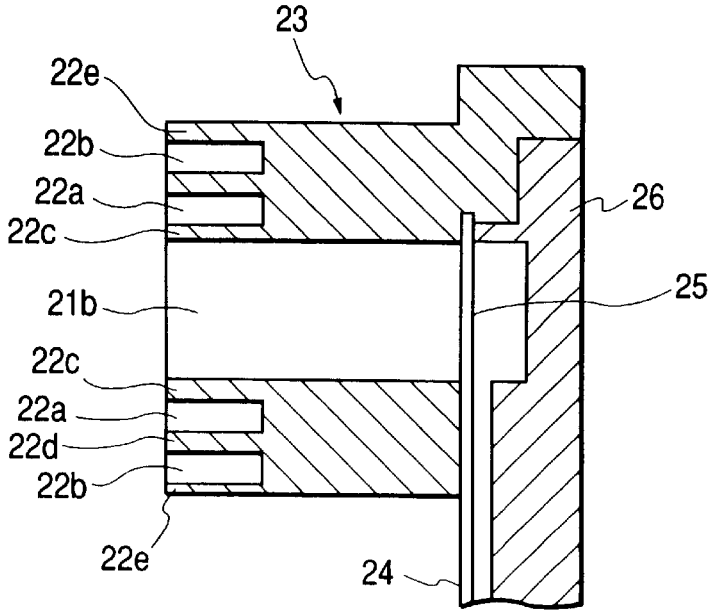
FIG. 13 PRIOR ART
FIG. 13 is a cross section of the conventional feedhorn of FIG. 12.

Embodiments of the feedhorn of the invention will be described hereinbelow by referring to the drawings. FIG. 1 is a plan view of a feedhorn according to a first embodiment of the invention. FIG. 2 is a front view of the feedhorn. FIG. 3 is a cross section of the main part of the feedhorn. FIG. 4 is a cross section of the main part of a modification of the feedhorn according to the first embodiment of the invention. FIGS. 5 and 6 are diagrams of a converter to which the feedhorn of the invention is attached. FIG. 7 is a plan view of a feedhorn according to a second embodiment of the invention. FIG. 8 is a front view of the feedhorn of FIG. 7. FIG. 9 is a cross section of the main part of the feedhorn. FIG. 10 is a schematic view for explaining a receiving antenna according to the invention. FIG. 11 is a schematic view for explaining the relation with broadcasting satellites according to the invention.

In a feedhorn 1 of a first embodiment of the invention, as shown in FIG. 3, at least first and second waveguides 4 and 5 each having an axis B in parallel with the center line A are integrally formed by die casting using aluminum or the like in positions so as to face each other over the center line B.

On the lines extended from the axes B and B of the first and second waveguides 4 and 5, first and second horns 6 and 7 are linked to the upper sides (in the diagram) of the first and second waveguides 4 and 5, respectively, so as to be symmetrical with respect to the center line A.

The first waveguide 4 and the first horn 6 have an aperture 8 penetrating in the axis B direction. The second waveguide 5 and the second horn 7 have an aperture 9 penetrating in the axis B direction. At the upper ends shown in FIG. 3 of the first and second horns 6 and 7, the apertures 8 and 9 are provided with flat aperture end faces 6*a* and 7*a*, respectively.

The diameter of the aperture 8 on the aperture end face 6*a* side is larger than that on the first waveguide 4 side. The diameter of the aperture 9 on the aperture end face 7*a* side is larger than that on the second waveguide 5 side. Each of the inner faces 6*b* and 7*b* of the apertures 8 and 9 of the first and second horns 6 and 7 has an internal cone shape.

The first and second horns 6 and 7 are formed so that each of their aperture end faces 6*a* and 7*b* is inclined toward the center line A side by a predetermined angle β.

On the inner conical face 6*b* of the first horn 6 on the left side of the diagram, a plurality of concentrical grooves 6*c*, 6*c* having different distances from the axis B of the horn 6 are formed with a predetermined depth by being partitioned with partition walls 6*d*, 6*e* and 6*f* so that their widths are almost the same.

The grooves 6*c* and 6*c* are formed so that their depth direction is parallel to the center line A. The aperture end face 6*a* at the outer end of the first horn 6 is formed flatly at the end face of the partition wall 6*d* on the outer radius side.

End faces 6*g* and 6*h* formed on the partition walls 6*e* and 6*f* on the inner radius side are also flat. The partition walls 6*d*, 6*e* and 6*f* are arranged so that their heights are different like stairs. The end faces 6*g* and 6*h* on the inner radius side of the aperture end face 6*a* are formed in parallel with the aperture end face 6*a* inclined toward the center line A by a predetermined angle β.

The predetermined angle β of inclination of the aperture end face 6*a* and the end faces 6*g* and 6*h* toward the center line A is set within the range from 2 to 10 degrees with respect to a plane which perpendicularly crosses the center line A (horizontal plane in FIG. 3). In such a manner, the first horn 6 on the left side in the diagram is constructed.

Since the second horn 7 on the right side in the diagram is symmetrical to the first horn 6 on the left side in the diagram, its detailed description is omitted here. On the internal conical face 7*b* of the second horn 7, a plurality of concentrical grooves 7*c*, 7*c* having different distances from the axis B of the second horn 7 are formed. The grooves 7*c* and 7*c* are partitioned by partition walls 7*d*, 7*e*, and 7*f*.

The aperture end face 7*a* is constructed by the end face of the partition wall 7*d* and is formed so as to be inclined toward the center line A by a predetermined angle β. End faces 7*g* and 7*h* of the partition walls 7*e* and 7*f* on the inner radius side are formed flat, respectively, and the partition walls 7*d*, 7*e* and 7*e* are arranged so that their heights are different like stairs.

The end faces 7*g* and 7*h* are formed so as to be inclined by the predetermined angle β in parallel with the aperture end face 7*a*. In a manner similar to the first horn 6, the predetermined angle β is set within a range from 2 to 10 degrees from the plane which perpendicularly crosses the center line A. In such a manner, the second horn 7 on the right side of the diagram is constructed.

In the case of processing the feedhorn 1 of the invention having such a construction by, for example, die casting, the first and second waveguides 4 and 5 and the first and second horns 6 and 7 are integrally simultaneously processed by a die cast (not shown). After that, the feedhorn 1 is pulled out in the direction parallel to the center line A from the die casting die, thereby enabling the feedhorn 1 to be easily taken out from the die.

The feedhorns 1 of the same quality can be therefore manufactured in large quantity by the die casting process. The high-quality low-cost feedhorn 1 can be manufactured.

The predetermined inclination angle β of each of the aperture end face 6*a* and 7*a* of the first and second waveguides 4 and 5 and the end faces 6*g*, 6*h*, 7*g*, and 7*h* of the partition walls 6*e*, 6*f*, 7*e*, and 7*f* is set to the half of an angle α formed between at least two neighboring broadcasting satellites, for example, S1 and S2 to a receiving antenna T on the ground for receiving radio waves transmitted from the broadcasting satellites S1 and S2 as shown in FIG. 11 which will be described hereinlater.

The feedhorn 1 of the invention is attached to the antenna T so that the aperture end faces 6*a* and 7*a* are perpendicular to the travel direction of radio waves which are transmitted from at least two neighboring broadcasting satellites S1 and S2 or S2 and S3 orbiting around the earth and which are reflected by an antenna 3 on the ground. The broadcasting satellites and the antenna 3 will be described hereinlater.

Consequently, the radio waves transmitted from at least two neighboring broadcasting satellites S1 and S2 can be efficiently received by the pair of horns 6 and 7 and the waveguides 4 and 5, respectively.

A feedhorn 31 as a modification of the first embodiment will be described with reference to FIG. 4. A pair of waveguides 34 and 35 each having an axis B parallel to the center line A are disposed. A pair of horns 36 and 37 linked to the waveguides 34 and 35, respectively, are formed.

The waveguide 34 and the horn 36 have an aperture 38 formed in the direction of the axis B. The waveguide 35 and the horn 37 have an aperture 39 formed in the direction of the axis B.

The apertures 38 and 39 have aperture end faces 36*a* and 37*a* at the outer ends, respectively. The aperture end faces 36*a* and 37*a* are inclined toward the center line A by the predetermined angle β. The diameter of the aperture 38 at the aperture end face 36*a* is larger than that on the waveguide 34 side. The diameter of the aperture 39 at the aperture end face 37*a* is larger than that on the waveguide 35 side. In the apertures 38 and 39, each of the inner faces 36*b* and 37*b* of the horns 36 and 37 may have an internal conical shape.

The feedhorn 1 or 31 of the first embodiment is attached to a converter 2 having a casing 2*a* as shown in FIGS. 5 and 6. The converter 2 transmits wave signals from the broadcasting satellites S1 and S2, or S2 and S3 received by the feedhorn 1 from a receiving circuit in the casing 2*a* to an external receiver (not shown) via a lead terminal 10.

A feedhorn 41 of a second embodiment of the invention will be described with reference to FIGS. 7, 8 and 9. Since the first and second waveguides 4 and 5 and the first and second horns 6 and 7 in the feedhorn 41 of the second embodiment have the same constructions as those of the first embodiment, the components are designated by the same reference numerals and their detailed description is omitted here.

On the right side in FIG. 7, the first waveguide 4 and the first horn 6 are formed. On the left side in FIG. 7, the second waveguide 5 and the second horn 7 are formed. Between the first and second waveguides 4 and 5, a third waveguide 44 having an axis G parallel to the axes B and B of the first and second waveguides 4 and 5 is integrally formed. The axis G of the third waveguide 44 extends in a position off from a line H connecting the axes B and B of the first and second waveguides 4 and 5 by a predetermined distance J toward the upper side in the diagram. As shown in FIG. 7, the feedhorn 41 has a dogleg shape in front view.

The feedhorn 41 has a center line F which is lower (in the diagram) than the axis G of the third waveguide 44, near to the line H connecting the axes B and B of the first and second waveguides 4 and 5, and parallel to the axis G.

Specifically, in symmetrical positions with respect to the center line F, the first and second waveguides 4 and 5 having axes B and B parallel to the center line F are formed.

The third waveguide 44 has, as shown in FIG. 9, a third horn 46 linked to the third waveguide 44 on the extended line of the axis G. An aperture 48 is formed in the direction of the axis G in the third waveguide 44 and the third horn 46.

The third horn 46 has an open end face 46*a* at the outer end in the upper side in the diagram of the third horn 46. The diameter of the aperture 48 on the open end face 46*a* side is larger than that on the third waveguide 44 side.

The inner face of the aperture 48 on the third horn 46 side has an internal conical shape. On the conical internal face, as shown in FIG. 9, a plurality of concentrical grooves 46*c*, 46*c* having different distances from the axis G are formed at a predetermined depth by being partitioned with partition walls 46*d*, 46*e*, and 46*f*. The end face of each of the partition walls 46*d*, 46*e*, and 46*f* is formed flatly.

The outer partition wall 46*d* is constructed by the flat open end face 46*a*. End faces 46*g* and 46*h* of the partition walls 46*e* and 46*f* are also formed flatly.

The partition walls 46*d*, 46*e*, and 46*f* are arranged so that their heights are different like stairs. The open end face 46*a* is inclined toward the center line F at the predetermined angle β.

The end faces 46*g* and 46*h* on the inner radius side of the open end face 46*a* are also inclined toward the center line F at the predetermined angle β in parallel with the open end face 46*a*.

Each of the feedhorns 1 and 41 of the first and second embodiments of the invention is used for a receiving antenna T for receiving radio waves from broadcasting satellites as shown in FIG. 10. The receiving antenna T has a reflection type parabolic antenna 3 and the converter 2 which has therein a receiving circuit (not shown) and the like and to which the feedhorn 1 or 41 is attached.

As shown in FIG. 11, a plurality of neighboring broadcasting satellites S1, S2 and S3 orbiting around the earth are positioned at relatively shorter intervals in association with the increase in the number of satellite broadcasting channels and the like in recent years.

An angle α formed by neighboring broadcasting satellites among the plurality of neighboring broadcasting satellites S1, S2 and S3 to the receiving antenna T on the ground for receiving radio waves transmitted from the broadcasting satellites S1, S2 and S3 is, for example, approximately 10 degrees.

In order to receive radio waves transmitted from the desired neighboring broadcasting satellites S1, S2 and S3 orbiting around the earth by attaching, for example, the feedhorn 41 of the second embodiment to the receiving antenna T, as shown in FIG. 11, the antenna 3 is mounted so that its parabolic surface faces the desired neighboring broadcasting satellites S1, S2 and S3.

The feedhorn 41 is attached so that each of the open end faces 6*a*, 7*a* and 46*a* is tilted toward the center line F at the predetermined angle β so as to be perpendicular to the travel direction of the radio waves transmitted from the broadcasting satellites S1, S2, and S3 and reflected by the antenna 3 on the ground.

Consequently, the radio waves transmitted from the neighboring three broadcasting satellites S1, S2 and S3 are received by the receiving antenna T on the ground with high accuracy. The received radio waves are supplied to the receiving circuit in the converter 2 via the feedhorn 41.

In the feedhorn of the invention, the first waveguide and the first horn have an aperture formed in the axial direction, the second waveguide and the second horn have an aperture formed in the axial direction, the former aperture is provided with an aperture end face at an outer end of the first horn, the latter aperture is provided with an aperture end face at an outer end of the second horn, the diameter of the aperture on the aperture end face side is larger than that on the side of each of the first and second waveguides, the inner face of the aperture on the side of each of the first and second horns has an internal cone shape, and each of the aperture end faces of the first and second horns of the first and second waveguides is tilted toward the center line by a predetermined angle so that the first and second horns are perpendicular to the travel directions of radio waves transmitted from at least two broadcasting satellites orbiting around the earth and reflected by an antenna on the ground. Thus, the high-performance feedhorn capable of very accurately receiving radio waves sent from at least two neighboring broadcasting satellites orbiting around the earth can be provided.

On the internal conical face, a plurality of concentrical grooves having different distances from the axis are formed at a predetermined depth by being partitioned with partition walls, an end face of each of the partition walls is formed flatly, the partition walls are arranged so that their heights are different from each other like stairs, and the end face of each of the partition walls is formed in parallel with the aperture end face of the horn. Consequently, a high-quality feedhorn capable of receiving radio waves from a plurality of neighboring broadcasting satellites with higher accuracy can be provided.

Since the depth direction of each of the grooves is in parallel with the center line, after manufacturing the feedhorn by, for example, die casting, the feedhorn can be easily pulled out in the center line direction. Consequently, a high-quality low-cost feedhorn which can be mass produced without variations in manufacturing quality can be provided.

Since an inclination angle of each of the aperture end faces of the first and second waveguides and the end faces of the partition walls lies within the range from 2 to 10 degrees with respect to a plane which perpendicularly crosses the center line, the aperture end faces and the end faces of the partition walls are perpendicular to the transmission direction of radio waves transmitted from the plurality of neighboring broadcasting satellites. The radio waves from the plurality of neighboring broadcasting satellites can be therefore received with high accuracy.

An inclination angle of each of the aperture end faces of the first and second waveguides and the end faces of the partition walls is set to the half of an angle formed between a plurality of neighboring broadcasting satellites and a receiving antenna on the ground for receiving radio waves transmitted from the broadcasting satellites. Consequently, radio waves from the plurality of neighboring broadcasting satellites can be received with high accuracy.

The third waveguide and the third horn have an aperture formed in the axial direction. The aperture is provided with an aperture end face at the outer end of the third horn, the diameter of the aperture on the aperture end face side is larger than that on the third waveguide side, the inner face of the aperture on the third horn side has an internal conical shape, and the aperture end face of each of the first, second, and third horns is inclined toward the center line at a predetermined angle so that the first, second, and third horns are perpendicular to the travel directions of radio waves which are transmitted from neighboring three broadcasting satellites orbiting around the earth and reflected by an antenna on the ground. Consequently, the feedhorn capable of receiving radio waves from the neighboring three broadcasting satellites can be provided.

Since the first, second, and third waveguides are arranged in a state where a line connecting the axes of the first and second waveguides is deviated from the axis of the third waveguide by a predetermined distance, the waves from the neighboring three broadcasting satellites can be received with high accuracy.

What is claimed is:

1. A feed horn comprising:

first and second waveguides disposed at symmetrical positions with respect to a center line, each waveguide having an axis parallel to the center line; and first and second horns linked to the first and second waveguides, respectively, on extension lines of the axes of the first and second waveguides, wherein the first waveguide and the first horn have an aperture formed in the axial direction, the second waveguide and the second horn have an aperture formed in the axial direction, the first aperture is provided with an aperture end face at an outer end of the first horn, the second aperture is provided with an aperture end face at an outer end of the second horn, a diameter of each aperture on the aperture end face side is larger than a diameter of the aperture on the side of each of the first and second waveguides, an inner face of the aperture on the side of each of the first and second horns has an internal cone shape, and each of the aperture end faces of the first and second horns of the first and second waveguides is tilted toward the center line by a predetermined angle such that the first and second horns are perpendicular to travelling directions of radio waves transmitted from at least two broadcasting satellites orbiting around the earth and reflected by an antenna on the ground.

2. A feedhorn according to claim 1, wherein on each internal conical face, a plurality of concentrical grooves having different distances from the axis are formed at a predetermined depth by being partitioned with annular partition walls, an end face of each of the partition walls is formed flatly, the end faces of the partition walls are arranged in increasing diameter toward the end face of the corresponding aperture and centered on the corresponding axis, and the end face of each of the partition walls is formed in parallel with the corresponding aperture end face.

3. A feedhorn according to claim 2, wherein a depth direction of each of the grooves is in parallel with the center line.

4. A feedhorn according to claim 2, wherein an inclination angle of each of the aperture end faces is 2 to 10 degrees, inclusive, with respect to a plane which perpendicularly crosses the center line.

5. A feedhorn according to claim 2, wherein an inclination angle of each of the aperture end faces is half of an angle formed between a plurality of neighboring broadcasting satellites and a receiving antenna on the ground for receiving radio waves transmitted from the broadcasting satellites.

6. A feedhorn according to claim 1, wherein a third waveguide having an axis parallel to the center line is disposed between the first and second waveguides, the first and second waveguides disposed away from the center line, the third waveguide has a third horn which is on an extension line of the axis and is linked to the third waveguide, an aperture of the third waveguide is formed in an axial direction in the third waveguide and the third horn, the aperture of the third waveguide is provided with an aperture end face at an outer end of the third horn, a diameter of the aperture of the third waveguide on the aperture end face side is larger than a diameter of the aperture of the third waveguide on the third waveguide side, an inner face of the aperture of the third waveguide on the third horn side has an internal conical shape, and the aperture end face of each of the first, second, and third horns is inclined toward the center line at a predetermined angle such that the first, second, and third horns are perpendicular to travelling directions of radio waves which are transmitted from neighboring three broadcasting satellites orbiting around the earth and reflected by an antenna on the ground.

7. A feedhorn according to claim 6, wherein the first, second, and third waveguides are arranged in a state where a line connecting the axes of the first and second waveguides is deviated from the axis of the third waveguide by a predetermined distance.

8. A feedhorn according to claim 6, wherein on each internal conical face, a plurality of concentrical grooves having different distances from the axis are formed at a predetermined depth by being partitioned with annular partition walls, an end face of each of the partition walls is formed flatly, the end faces of the partition walls are arranged in increasing diameter toward the end face of the corresponding aperture and centered on the corresponding axis, and the end face of each of the partition walls is formed in parallel with the corresponding aperture end face.

9. A feedhorn according to claim 8, wherein an inclination angle of each of the aperture end faces of the first and second horns is 2 to 10 degrees, inclusive, with respect to a plane which perpendicularly crosses the center line.

10. A feedhorn according to claim 6, wherein the three waveguides form a dogleg such that the axis of the first and second waveguides are separated by a particular distance, the axis of the third waveguide and the center are respectively offset perpendicularly from a middle of the particular distance by a larger and smaller amount of displacement.

* * * * *